United States Patent [19]

Sams

[11] Patent Number: 4,848,704

[45] Date of Patent: Jul. 18, 1989

[54] AERODYNAMIC DEVICES

[75] Inventor: Kenneth Sams, London, England

[73] Assignee: U.F.O., Inc., Panama, Panama

[21] Appl. No.: 107,869

[22] Filed: Oct. 8, 1987

Related U.S. Application Data

[63] Continuation of Ser. No. 824,690, Jan. 3, 1986, abandoned.

[30] Foreign Application Priority Data

May 8, 1984 [GB] United Kingdom ..... 8411714
Jan. 16, 1985 [GB] United Kingdom ..... 8501090

[51] Int. Cl.[4] ..... B64C 31/06
[52] U.S. Cl. ..... 244/153 A
[58] Field of Search ..... 244/153 A, 39, 19, 21; D21/92, 93, 85, 86; 416/4; 446/34, 36, 38, 236, 255, 217, 218

[56] References Cited

U.S. PATENT DOCUMENTS

| | | | |
|---|---|---|---|
| D. 207,477 | 4/1967 | McLarty | D21/93 |
| 3,026,073 | 7/1959 | Albertson, Jr. | 244/153 A |
| 3,526,377 | 5/1967 | Flatau | 244/153 A |
| 3,747,263 | 7/1973 | Grossberg | 446/217 |
| 4,012,017 | 6/1976 | Springston et al. | 244/153 A |
| 4,243,190 | 1/1981 | Sams | 244/9 |

*Primary Examiner*—Joseph F. Peters, Jr.
*Assistant Examiner*—Rodney Corl
*Attorney, Agent, or Firm*—Flynn, Thiel, Boutell & Tanis

[57] ABSTRACT

The device includes a rotor (2) mounted for rotation about an axis transverse to a restraining line (4) by means of a bearing (10). The rotor may comprise two lift members (6) each in the form of a short, lightweight tube mounted on a stiff but flexible rod (8) which extends diametrically across each tube and through the bearing (10).

24 Claims, 5 Drawing Sheets

AERODYNAMIC DEVICES

This application is a continuation of U.S. Ser. No. 824,690, filed Jan. 3, 1986, now abandoned.

FIELD OF THE INVENTION

This invention relates to aerodynamic devices for example for kites, hang gliders and display devices.

BACKGROUND OF THE INVENTION

According to the present invention there is provided an aerodynamic device having a rotor coupled to retaining means which define an axis of rotation for the rotor, the rotor comprising a wall which extends between two spaced positions on the axis and is spaced from the axis between said positions, the axis of rotation of the rotor passing through or adjacent to its centre of gravity.

When there is relative movement between the air and the rotor the rotor rotates and in so doing it modifies the air flow in the region of the rotor so that it experiences an aerodynamic lift force. The lift force is accomplished by a relatively small drag force.

BRIEF DESCRIPTION OF THE DRAWINGS

The invention will be further described, by way of example, with reference to the accompanying drawings in which.

DETAILED DESCRIPTION

Figure 1:
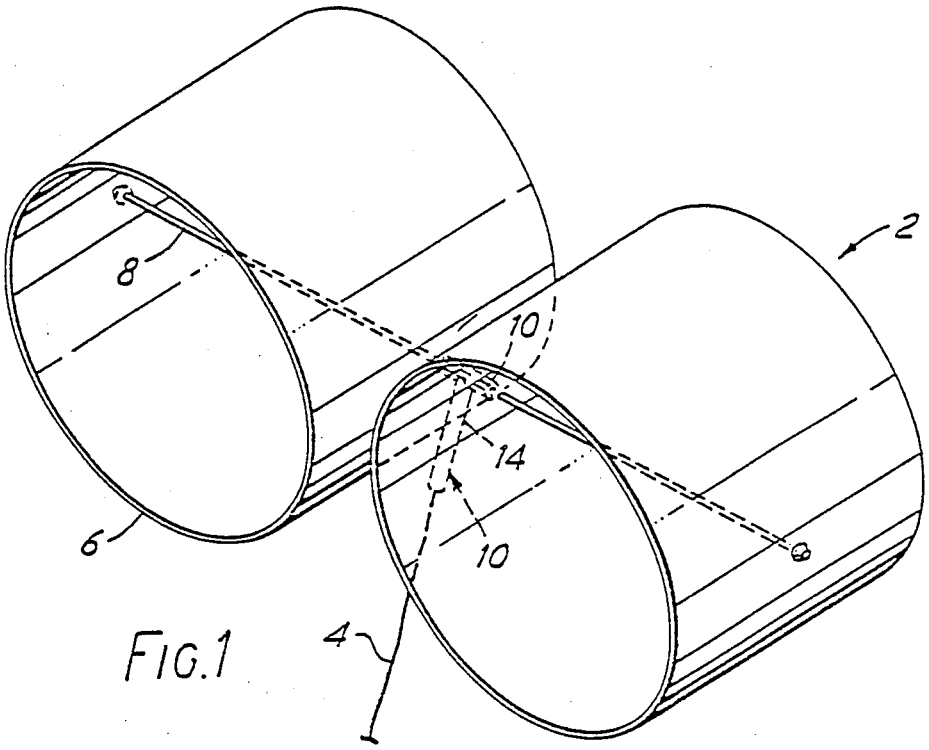
FIG. 1 is a perspective view of an aerodynamic device embodying the invention.

In the drawings, FIG. 1 shows a kite having a rotor 2 and an anchor or hand line 4 which may be of elastic material. The rotor comprises twoo identical circularly cylindrical lift members 6 rigidly secured to a transverse rod 8 with their cylinder axes parallel to one another. Each lift member is open at opposed ends and has a continous thin cylindrical wall which defines a passage between the ends. The axial length of the lift members (measured parallel to their respective axes) is approximately equal to their diameter. The members may be fixed to the rod by blobs 7 of adhesive.

Alternatively, where the lift members are of resiliently deformable material, the blobs 7 may be replaced by tightly fitting elastomeric grommets capable of being slid along the rod 8 to positions (either on or off the rod) in which the rotor may be packed flat.

A bearing member 10 connects the restraining line 4 to the rod 8 at a position between the lift members 6 corresponding to the centre of gravity of the rotor so that the lift members and the rod can rotate with respect to the bearing member and line. The rod 8 passes diametrically across the mid-plane of each lift member and thus passes through the centre of gravity of each lift member.

The bearing member is 'T'-shaped. The cross-member of the 'T' is a tube which rotatably receives the rod 8. The free end of the upright of the 'T' is secured to the line 4.

The walls of the lift members may be of rigid plastics sheet material. Flimsier material such as plastic film may be used, retained on a frame or former, e.g. of stiff wire. The walls may be covered with a reflective metallized finish to create a brilliant appearance, particularly in sunlight. One suitable film is MYLAR, which has a reflective silvery surface. Various materials other than plastics materials may be used, including woven and paper products.

When the kite is flying the wind causes the rotor and its rod 8 to spin with respect to the bearing member 10 and line 4. The spinning lift members generate a lift force accompanied by a relatively small drag force. If the user tugs the line the lift members surge upwards with each tug and rotate more rapidly. With higher wind speeds, the rotor flexes into a flat V shape reducing the wind resistance of the rotors.

Figure 2:
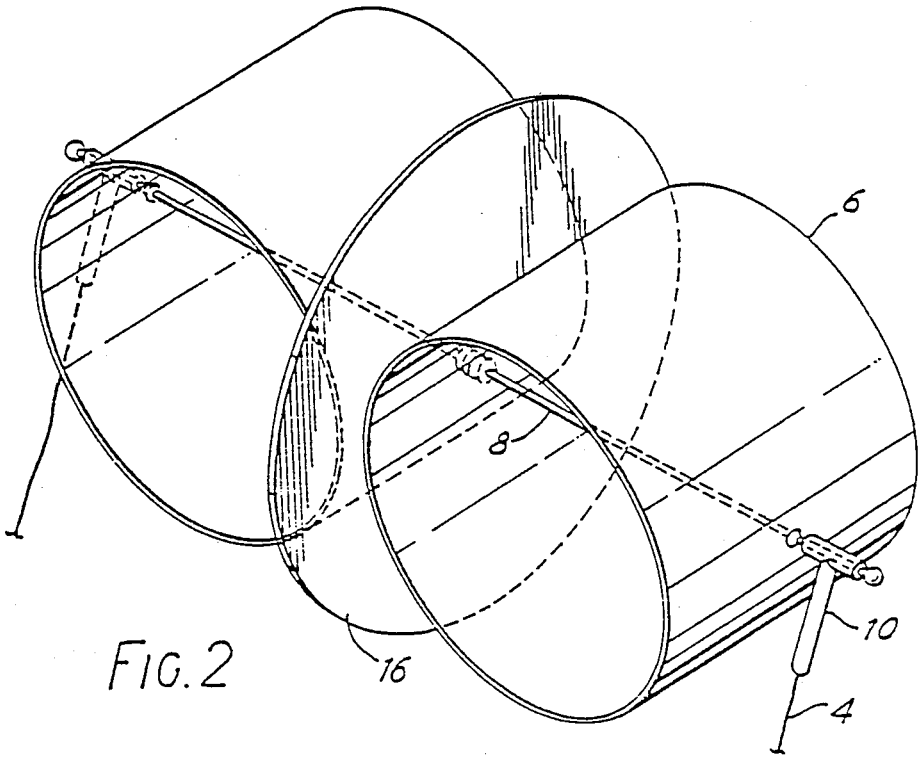
FIG. 2 is a device similar to FIG. 1, modified to include two hand lines and a stabilizing disk.

The kite shown in FIG. 2 is similar to that of FIG. 1, in having two identical and identically disposed circularly cylindrical lift members 6 secured to a rod 8 which passes through the mid-plane of each lift member. However, in this embodiment there are two hand lines 4, to enable manoeuvers to be performed. The hand lines are connected to the rod by identical T-shaped bearing members 10 at opposite ends of the rod, and thus on opposite sides of the lift members. A circular stabilizing disc 16 is fixed to the rod 8 between the lift members to rotate with them. The plane of the stabilizing disc 16 is perpendicular to the rod and its diameter slightly exceeds the diameter of the cylindrical lift members.

Figure 3:
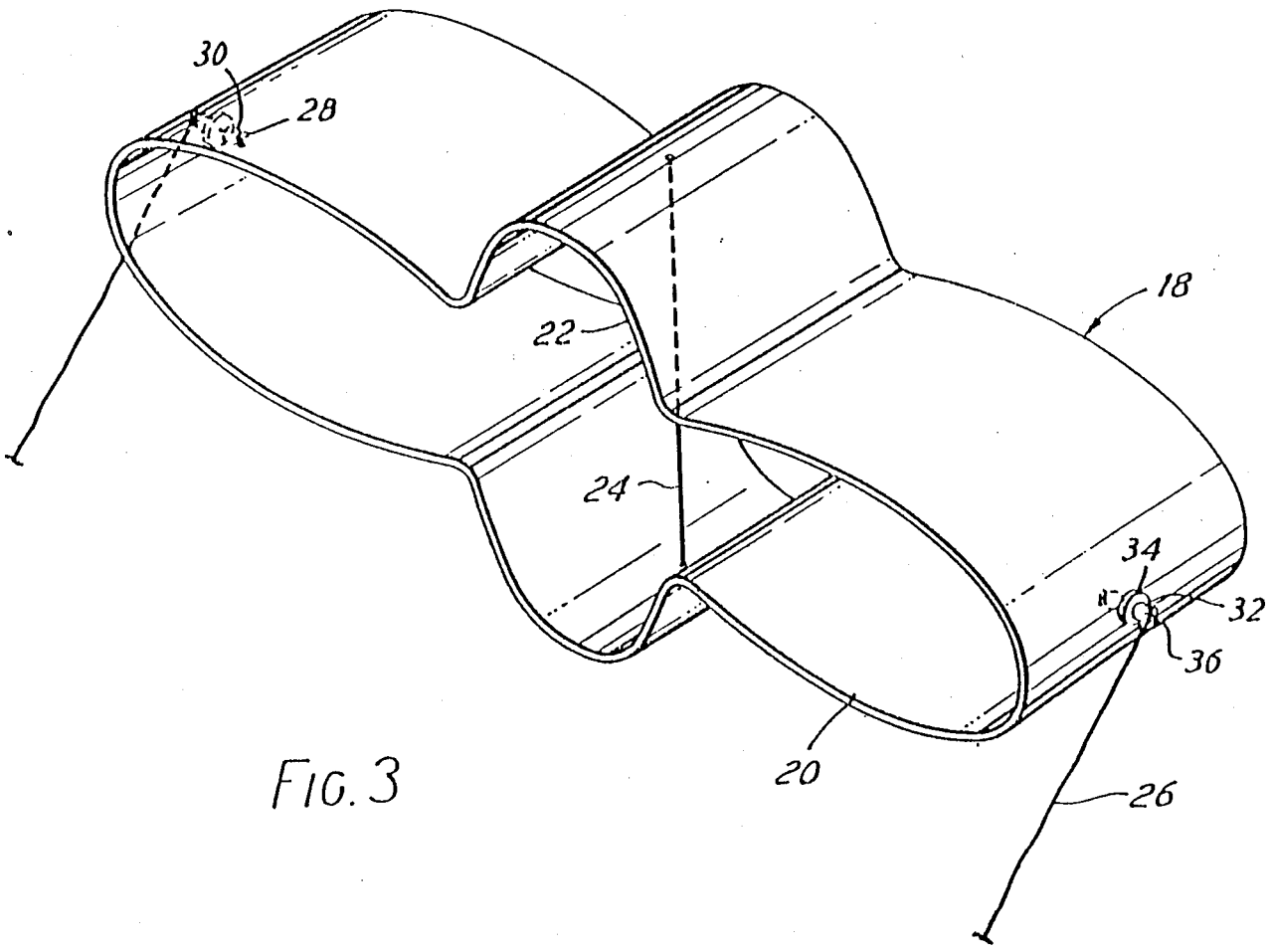
FIG. 3 is a perspective view of an aerodynamic device embodying the invention and having a modified rotor.

The kite shown in FIG. 3 has its rotor formed by a single lift member 18 formed from a flexible material, such as expanded polystyrene, with an axial passage of constant cross section. The lift member has four lobes, two identical large lobes 20 which extend outwardly in opposite directions, generally parallel to the axis of rotation of the lift member and two smaller lobes 22 identical with one another, and which extend outwardly in opposite directions generally perpendicular to the axis of rotation. The ends of the lobes 22 are spaced apart by a distance which slightly exceeds the length of the passage within the lift member.

Between the respective ends of the smaller lobes 22 extends an elasticated line 24.

Two hand or anchor lines 26 are connected to the lift member. One is connected to the extremity of one larger lobe 20 and the other to the extremity of the other lobe. The end of each line 26 passes through the wall of the lift member and terminates in a knot 28. A bead 30 is retained between the knot 28 and the inner surface of the wall of the lift member. Each line 26 also passes through a bead 32 and a button or washer 34 on the outside of the lift member, retained between a knot 36 and the outer surface of the lift member, against which the washer bears.

This arrangement is a simple way of allowing the lift member to rotate freely with respect to the hard lines. Many other sample arrangements could be used, e.g. a line passing right through the lift member from one end to the other, knotted to the hard lines or extending continuously therefrom, as a result of the use of a single continuous length of line which forms the hard lines and the portion through the lift member interconnecting the hard lines; or a bearing arrangement of the type shown in FIGS. 1 and 2.

When the lift member of FIG. 3 rotates about the lines 26 it generates lift in the manner of the lift members of FIGS. 1 and 2. However, unlike the latter lift members the lift member of FIG. 3 can alter its shape in different wind conditions. In a light wind the lift member generates maximum lift with the configuration shown in FIG. 3. When the wind is stronger the lift member expands in breadth, that is in the direction perpendicular to the axes of the passage and of rotation, stretching the elasticated line 24. The expansion is accommodated by a temporary elastic deformation of the wall of the lift member. The expanded lift member flies well in strong winds, generating only a small drag force. When the wind drops the lift member, biassed by the extended elasticated line 24, returns to its original configuration and generates increased lift.

The expandable lift member of FIG. 3 uses an elasticated line to bias it to is unexpanded configuration but in alternative embodiments a spring could be used or the necessary elasticity could arise as a result of the properties of the material used t form the lift member.

Various designs of lift member can be used provided they satisfy the basic requirement that the member be open at both ends and define an axial passage between the ends. It is quite feasible to use a lift member of square of oval cross-section as well as of more irregular shape. It is not, moreover, essential that the passage be of uniform axial length. The wall of one embodiment of one lift member reduces in opposite directions parallel to the axis of rotation of the lift member, from a wide central region to narrower end regions. The length of the passage in the central region thus exceeds the length at the ends. In this embodiment the breadth of the passage also decreases from the central region towards the ends.

The axial length of the passage within a lift member should not substantially exceed the breadth (the largest dimension perpendicular to the axes of rotation and of the passage), due to the increased drag of more elongate members. The limit to be put upon the ratio of the length of a ligt member to its breadth depends to some extent on the particular design and application but would only rarely exceed 2-3, and will frequently be less than 1.5. The preferred ratio is at present in the region of 1. In embodiments in which the axial length varies it may be stated as a general guideline that the largest axial length of the passage should not substantially exceed its breadth.

Rotating stabilizer plates such as that shown in FIG. 2 are not essential for flight but may improve flying characteristics. a plurality of stabilizer plates may be used. A stabilizer plate on each side of a lift member, each perpendicular to the axis of rotation of the lift member, may serve to trap the airstream and direct it past the lift member, to generate more lift, as well as increasing its stability. Alternatively or additionally, stabilizer fins or planes on the rotor axis may be attached to the wall of a lift member or else a stabilizer ring may be secured around a lift member.

The stabilizers are preferably rigid by will function adequately if they are floppy, since they can adopt an upright position in a plane perpendicular to the axis of rotation when the lift member rotates.

Lift members can be coupled together in various ways. One arrangement is shown in FIGS. 1 and 2 where lift members are coupled together as a pair. A plurality of such pairs can be secured in spaced-apart relation to a line or a rod, the rod 8 of each pair joining the line or rod between the lift members of the pair. In another arrangement the lift member of FIG. 3 is retained for rotation across a first diameter of a rigid hoop which has co-operable conformations across the diameter of the hoop which is perpendicular to the first diameter so that a number of hoops can be joined together with the lift members within them having their axes of rotation parallel to one another and the hoops forming a linear array extending transversely to the axes of rotation.

In another arrangement a plurality of lines each carrying one or more lift members branch from a control rod or line.

Figure 4:
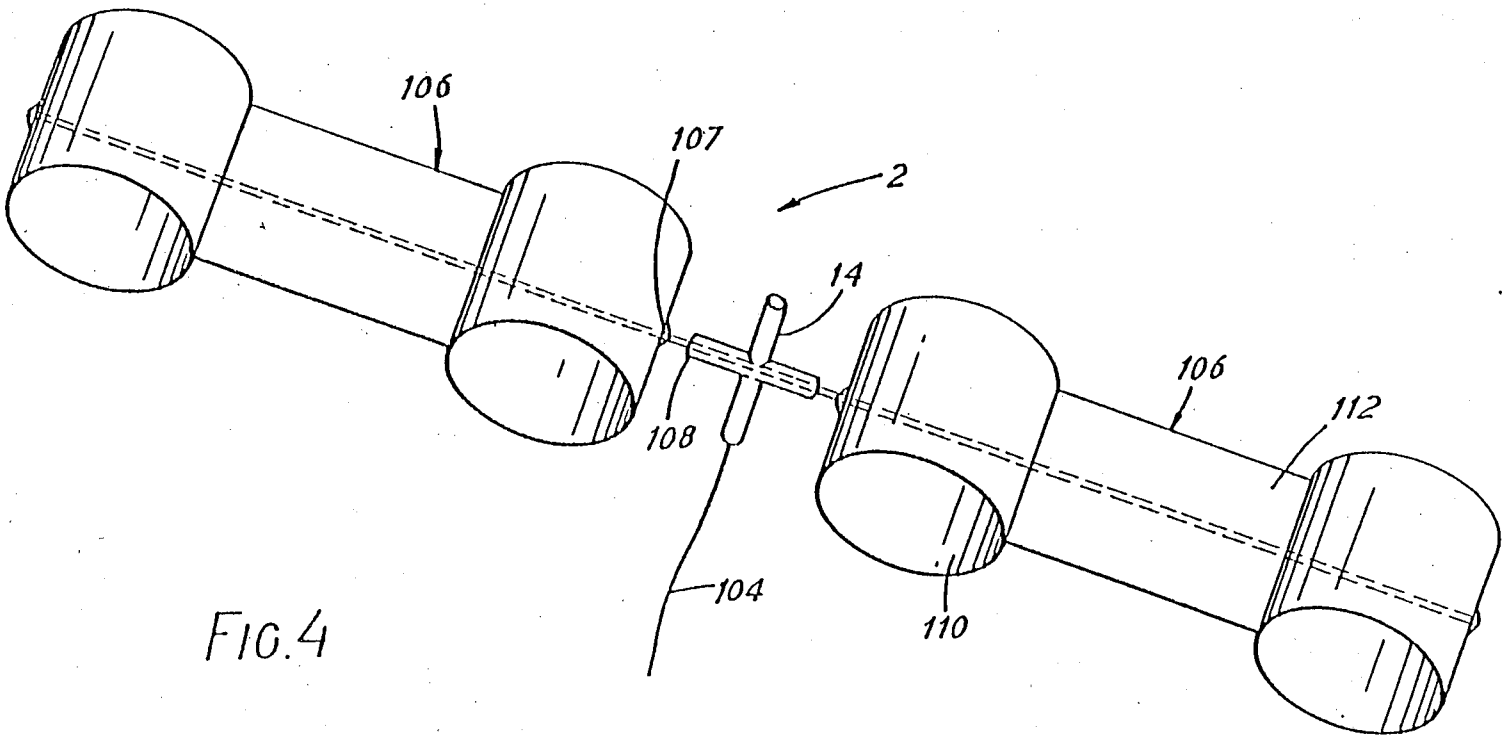
FIG. 4 is a perspective view of an aerodynamic device embodying the invention and having a further modified rotor.

In the kite shown in FIG. 4, the rotor comprises two identical lift members 106 each firmly secured (by grommets or adhesive blobs 107) to a rod 108 which passes from one end of the rotor to the other. The rod is or glass fibre reinforced resin and is stiff but resiliently deformable. Each lift member 106 comprises two identical circularly cylindrical tubes 110 whose axes are perpendicular to the rod 108, and a flat plane 112 between them, across which the rod 108 passes. Each tube 110 is open at opposed ends and has a continuous thin cylindrical wall which defines a passage between the ends. The axial length of the tubes is approximately equal to their diameter, and to the width of the sheet 112.

A bearing member 114 connects the restraining line 104 to the rod 108 at a position between the lift members 106 so that the rotor, that is, the lift members and the rod, can rotate with respect to the bearing member and line. the rod 108 passes diametrically across the midplane of each lift member and thus passes through the centre of gravity of each lift member. The rotor is balanced about the bearing member.

The bearing member 114 is cross-shaped. Two opposed arms rotatably receive the rod 108. One of the other arms is secured to the line 104 and the final arm may be used to connect a streamer to the kite, or to connect a line to a further rotor.

The walls of the lift members are of fairly rigid plastics sheet material, with a reflective metallized finish to create a brilliant appearance, particularly in sunlight.

Figure 5:
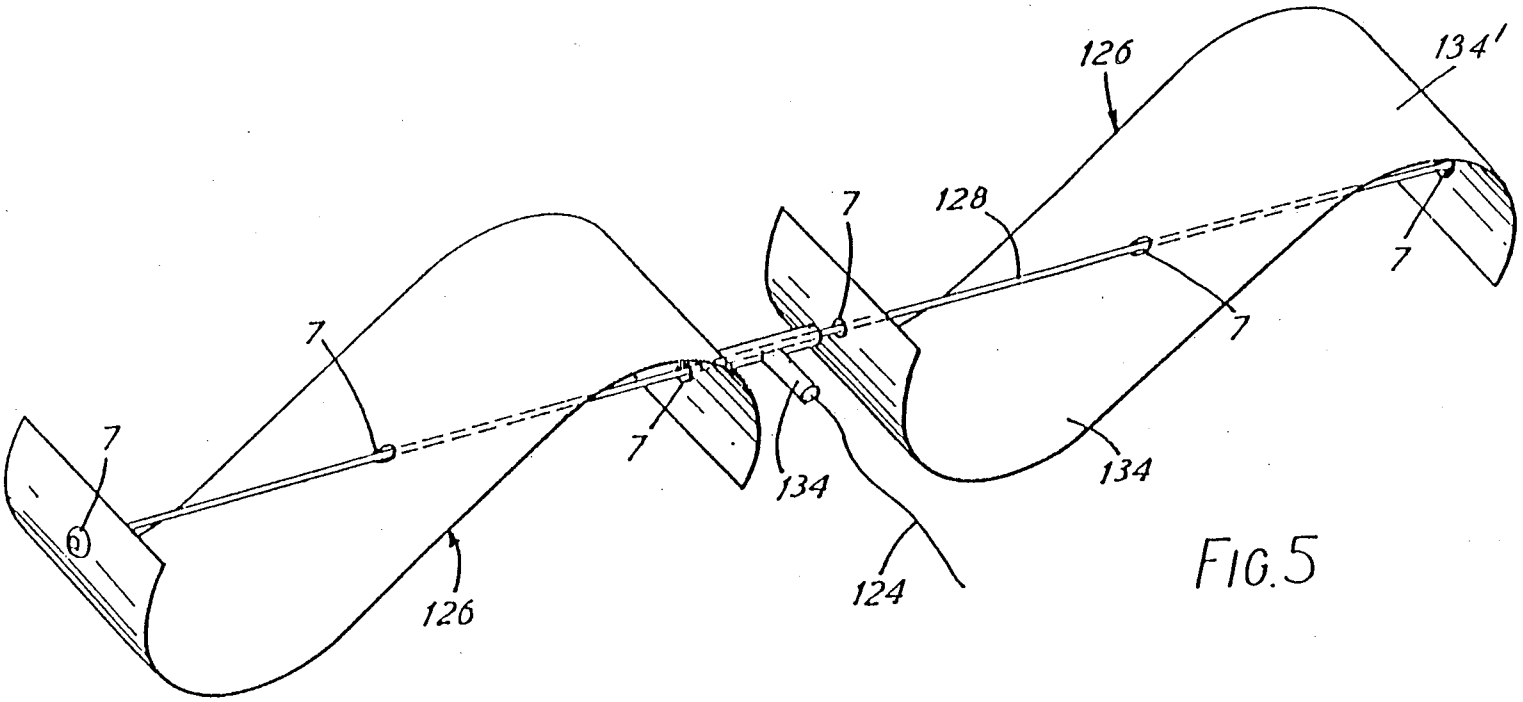
FIG. 5 is a perspective view of an aerodynamic device embodying the invention and having a still further modified rotor.

The kite shown in FIG. 5 also has a rotor having two lift members 126 and a rod 128 but in contrast to the kites of FIGS. 1 to 4, the lift members do not have cylindrical or other passage-defining parts. Instead, the cross-section of each lift member is sinusoidal, being generally S-shaped. The fibreglass rod 128 passes lengthwise and centrally through each lift member, and is secured to each lift member so that the rod and two lift member rotate together about the bearing member 134 and hand line 124.

The lift members of FIG. 5 may be made in various sizes. In one effective embodiment each lift member 126 is approximately 220 mm in length and the maximum spacing of the lift surfaces 134, 134' from the rod 128 is approximately 35 mm. The width of the lift member is approximately 70 mm.

Each lift member 126 may be considered as consisting of two side-by-side lift surfaces 134 of opposite orientation, each of which extends between two positions 136 coincident with the axis of rotation of the lift member, and is spaced from the axis between those positions. The lift surfaces 134 adjoining the bearing member 124, (one on each lift member) are of opposite orientation.

By way of contrast, each tube 110 of FIG. 4 may be considered as consisting of two hemi-cylindrical lift surfaces directly facing one another, each lift surface extending between end positions through which the rod 108 passes.

Figure 6:
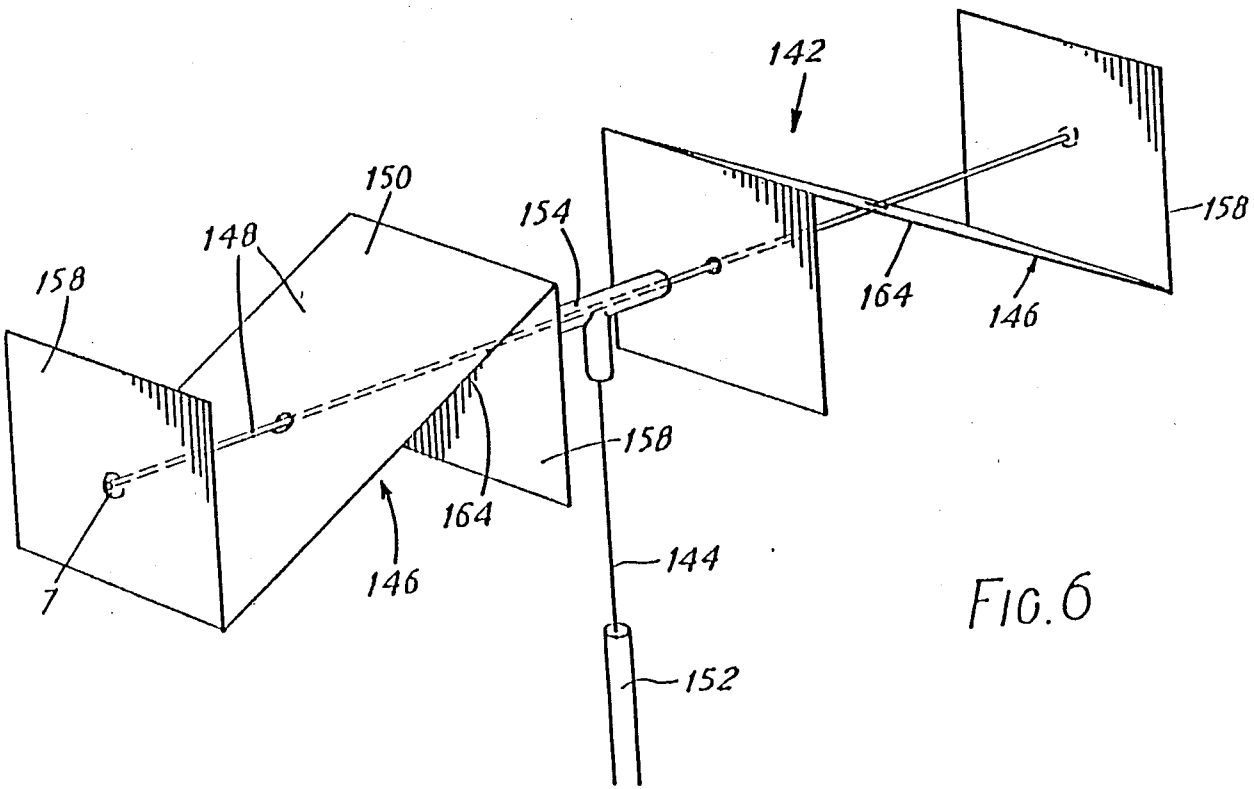
FIG. 6 is a perspective view of an aerodynamic device embodying the invention and having a still further modified rotor.

FIG. 6 shows a toy having a rotor 142, coupled through a bearing member 154 and an elastic line 144, a flexible hollow wand 152. The line 144 passes through the wand and carries a bead at its lower end, which bears against the lower end of the want, being too large to pass through it. The rotor differs from that of FIG. 5 in the shape of the lift members, each of which resembles a somewhat transversely stretched 'N' in cross section. Thus, each lift member 146 has end walls 158 each perpendicular to the rod 148 and a long diagonal wall 150 between the end walls. Unlike the FIG. 5 embodiment, the lift surfaces 164 adjoining the bearing member 154 (one on each lift member 146) face in the same direction.

The elastic line 144 is under slight tension even when the toy is not being used, and so draws the bead against the lower end of the wand and the bearing member 154 against the upper end. When the wand is waved the rotor rotates about the bearing member and lifts from the end of the wand, stretching the line, and assisting performance.

Other possible shapes of lift members may readily be used e.g. lift members of castellated profile. It is not necessary that the lift members on either side of the bearing member be identical but it is desirable to ensure that the rotor is balanced about the bearing member, and this is readily achieved by using identical lift members. In other embodiments two bearing members and hand lines may be employed, one at each end of the rotor.

Kites constructed according to the invention may be flown, in the usual way, simply for pleasure but may also be flown by lost hikers, drivers or sailors as a means to assist search parties in locating them. Such kites are provided with a reflective surface so that the spinning lift element of elements create a brilliant scintillating effect in sunlight. Further, the lift element or elements can be made radar detectable. Such kites can be attached to a car and towed in an extreme emergency such as being lost in a desert; they may be tacked to the mast of a boat encountering difficulties; towed by a bicycle; or secured to the backpack of a climber or hiker (e.g. by a line or a telescopic rod).

Another application of the invention is as a decoration, for example for ballrooms, gardens, or garage forecourts. A plurality of lift members, for example of the type shown in FIG. 3, may be connected together in a line and strung between retaining means such as poles. Thus, they may be threaded over a rod or cord, each spaced by a spacer such as a bead. Alternatively each lift member may be joined to its neighbours by a length of elastic line. If the elastic lines are fixed to the lift members for rotation with them different speeds of rotation between adjacent lift members will cause the elastic line between those lift members to twist and store energy which may eventually cause the lift members to spin in the reverse direction. The effect will be enhanced if an elastic line is fixed between the end lift members and the poles. The lift members of such a display line are free to rotate with respect to each other and may rotate in opposite directions to their neighbours. The use of elastic thread between the members may cause attractive effects such as the progressive change of the direction of rotation of the lift members, starting from one end and proceeding to the other.

The lift members of a display line may advantageously carry advertising messages.

Another application is as a toy for small children. In one embodiment the lift member is disposed at the upper end of a flexible hollow wand and is secured to the wand by an elastic line which runs inside the wand and carries at its lower end a bead which rests against the lower end of the wand, being too large to pass through it. The upper end of the line is connected to the centre of a bridle formed by a flexible rod bent into a curved shape and held in that shape by means of a filament secured to both of its ends. A lift member is rotatably retained on the filament with the axis of the passage perpendicular to it.

The elastic line is under slight tension even when the toy is not being used, and so draws the bead against the lower end of the wand and the bridle against the upper end. When the wand is waved the lift member rotates within the bridle and the lift member and bridle leave the end of the wand, stretching the elastic line. The elastic line may for example stretch to approximately twice the length of the wand.

In another embodiment two hollow wands are used. Each is retained on a length of elastic line which has a bead at its lower end. The lift member is again rotatable about a filament and the two elastic lines are connected to the filament one either side of the lift member.

One or more lift members carrying advertising messages may be flown from a flagpole located in a prominent public position e.g. the top of a building. Spotlights may be trained on the lift member or members which may flash out a message from reflective lettering while spinning. A preferred mounting is to secure the lift members to a rigid bridle in turn attached to a rod which passes within the hollow flagpole. A spring or elastic line is secured between the bottom of the flagpole and the end of the flexible rod. When the lift member(s) rotate the lift force causes the rod to rise. When the wind is strong the rod may even rise out of the flagpole but is pulled back into it by the spring force when the wind drops again.

Yet another application is as a parachute. the user pulls a cord to release compressed gas from a container and inflate a chamber to form a lift member of shape in accordance with the invention whereupon the lift member rotates as the parachutist descends, generating a lift force which brakes the descent.

An inflatable lift member may have applications other than as a parachute. Such a lift member may, for example, be used in a kite. For this purpose it need not be filled with gas from a container but could simply be inflated by mouth or using a foot pump.

Inflatable lift members, especially large ones, may advantageously be filled with helium so that they are naturally buoyant in the air.

The invention may be applied to manned aircraft, gliders, and hand gliders. For aircraft applications lift members are disposed symmetrically on either side of the fuselage of the aircraft and are rotated by a power unit, at a rate under the control of the pilot. The pilot would spin the lift members at the maximum rate to gain altitude and then spin them slowly, or hold them stationary at a required angle to the direction of flight, to cruise. To drop rapidly the lift members could be spun in the reverse direction to the direction in which they are spun to gain altitude.

One form of hang glider has a hollow rod passing diametrically through two circularly cylindrical lift members. Between the lift members and suspended from the rod is a cradle for the pilot. Cables pass from the cradle through the hollow rod to the outer part of each lift member so that when the pilot pulls the cables the circularly cylindrical lift members become oval in cross section with the major axis vertical. The lift members generate less lift when of oval cross-section than when of circular cross-section. When one cable only is pulled the hang glider is caused to bank. When the cables are released the lift members returns to their circularly cylindrical configuration due to the natural resilience of the material from which they are formed.

Should an aircraft, glider or hang glider constructed in accordance with the invention ever begin to descend in free fall the lift members will rotate in the sense required to generate an upward lift force and the downward motion will be braked, the lift members functioning like a parachute, as previously described.

The invention also has application to waterborne vessels. A lift member may be mounted on a mast, with its axis of rotation vertical, to generate a horizontal lift force. A plurality of lift members may be used, on one or more masts, and their positions controlled by rigging.

A lift member of a plurality of lift members may be retained on a mast secured to the nose of a motor boat with their axis or axes of rotation generally horizontal. When the motor drives the boat forwards the lift member(s) rotates to generate an upward lift force which can lift the nose of the boat from the water, greatly reducing the friction forces encountered.

The lift members used for boats and aircraft are preferably formed from materials with high strength-to-weight ratios such as carbon fibre and aluminium.

Applications of the invention to boats and aircraft may require the lift member or members to be held in a fixed position for certain periods. The lift member or members can be held stationary in various ways. One is to cause a plunger carrying a friction pad to engage a rod fixed to the lift member(s) for rotation therewith, coincident with the axis of rotation. Thus, the invention may also be applied to windmills.

It will be appreciated that as well as there being many possible designs of lift member there are also many applications for lift generating devices incorporating such members. The applications hereinbefore outlined are by no means exhaustive but are merely present to serve as examples. Similarly rigid materials and fabrics may be used. The restraining means may include a U- or V-shaped bridle connecting the line to bearing for the rotor.

I claim:

1. An aerodynamic device having a rotor coupled to retaining means which define an axis of rotation for the rotor, the rotor comprising one or more lift members each formed by a wall which is generated by straight lines transverse to the said axis, which wall extends between two spaced positions on the axis and is entirely spaced from the axis between said positions, the axis of rotation of the rotor passing through or adjacent to its center of gravity, all of said straight lines defining said rotor being parallel to one another and transverse to said axis, all of said straight lines defining said wall being spaced from said axis except at said spaced positions on said axis, said rotor constituting the entire rotatable structure of said aerodynamic device, the entire rotatable structure of said aerodynamic device being positionable such that from a point sufficiently remote from said axis of rotation one sees substantially only the edge outline of the rotatable structure of the aerodynamic device, which edge outline corresponds to the ends of said parallel straight lines in said rotatable structure, and substantially none of the surface of said one or more lift members.

2. The device of claim 1 in which the length of said lift member measured along said parallel straight lines is at least as great as the maximum distance of any of said parallel straight lines thereof from said axis of rotation.

3. An aerodynamic device having a rotor coupled to retaining means which define an axis of rotation for the rotor, the rotor comprising at least one lift member formed by a wall which is generated by straight lines transverse to the said axis, which wall extends between two spaced positions on the axis and is spaced from the axis between said positions, the axis of rotation of the rotor passing through or adjacent to its center of gravity, in which at least one of said wall generating straight lines is perpendicular to said rotational axis and intersects said rotation axis, said rotational axis and said intersecting straight line defining a first imaginary plane, said first plane dividing said lift member substantially into two halves, the two halves being substantially similar in size, said rotor constituting the entire rotatable structure of said aerodynamic device, all said straight lines defining said rotor being parallel to each other, a projection of the entire rotatable structure of said aerodynamic device onto a plane parallel to but spaced from the axis of rotation and perpendicular to said straight lines consisting only of the edge outline of the rotatable structure of the aerodynamic device.

4. A device according to claim 3, wherein said at least one lift member is open at opposed ends and the wall is continuous and defines an axial passage between the ends.

5. A device according to claim 4 wherein the passage is of substantially constant cross section transverse to its axis, throughout its axial length.

6. A device according to claim 4 wherein the or the greatest axial length of the passage does not substantially exceed its breadth (i.e. its maximum dimension in a direction transverse to the axes of rotation of the lift member and to the axis of the passage).

7. A device according to claim 4, wherein the wall of said at least one lift member is deformable against a resilient bias such that the breadth of the passage may increase in a direction transverse to the axis of rotation of the lift member.

8. A device according to claim 3 wherein the axis of rotation of said at least one lift member passes through its centre of gravity.

9. A device according to claim 3 further comprising a stabilizer plate lying in a plane which is transverse to the axis of rotation of said at least one lift member, for rotation therewith.

10. A device according to claim 9 in which the stabilizer plate is between two lift members.

11. A device according to claim 3 comprising a wing member interconnecting two lift members, the axis of rotation extending along the wing member.

12. A device according to claim 3 in which the ends of the wall of said at least one lift member are displaced from each other along the axis and the wall defines lobes on opposite sides of the axis and spaced along the axis.

13. A device according to claim 3 wherein the wall is fixed to an axial rod of the rotor by means permitting resistant sliding movement along the rod.

14. A device according to claim 3 in which said rotation axis intersects said wall at an angle thereto .

15. An aerodynamic device having a rotor coupled to retaining means which define an axis of rotation for the rotor, the rotor comprising a lift member formed by a wall which is generated by straight lines transverse to the said axis, which wall extends between two spaced positions on the axis and is spaced from the axis between said positions, the axis of rotation of the rotor passing through or adjacent to its centre of gravity, in which said lift member has the shape of an elongate strip of length extending along the rotation axis, said strip being bent through curves or creases at different locations along its length to enable said strip to cross the rotational axis, the strip being located symmetrically of said rotation axis so as to be substantially rotationally balanced on said axis, namely so that opposite sides of the rotational axis face toward substantially equal sized and shaped portions of said strip, said strip crossing said axis at least at three locations spaced serially along said axis.

16. A device according to claim 15 in which said wall generating straight lines are perpendicular to an imaginary plane containing said rotational axis, said imaginary plane dividing said wall into two substantially equal-width parts, the line of intersection of said wall with said imaginary plane defining the cross sectional profile of said lift member.

17. An aerodynamic lift force producing device comprising:

retaining means;

means rotatable with respect to said retaining means for producing an aerodynamic lift force on said retaining means, said rotatable lift force producing means consisting of a rotor coupled to retaining means which define an axis of rotation for the rotor, the rotor comprising a lift member formed by a wall which is generated by a plurality of straight lines transverse to the said axis, which wall extends between two spaced positions on the axis and is entirely spaced from the axis between said positions, the axis of rotation of the rotor passing through or adjacent to its center of gravity, all of said straight lines defining said rotor being parallel to one another and transverse to said axis, all of said straight lines defining said wall being spaced from said axis except at said spaced positions on said axis, the length of said parallel straight lines which generate said lift member exceeding the maximum perpendicular distance by which the lift member is offset from said axis of rotation.

18. The device of claim 17 in which the entire lift member has only simple and hence not complex curvature, and is constructed from a single flat strip of bendable nonstretchable material, said axis of rotation consisting of at least one length segment, there being no more than one lift member occupying each said length segment of said axis of rotation such that plural lift members do not overlap axially along said axis of rotation.

19. The device of claim 17 in which said rotor comprises an elongage rod rotatably supported by said retaining means, said rotor further comprising a pair of lift members said lift members being identical, each said lift member being a circular cylinder open at its opposed ends, the wall of each lift member being a continuous thin cylindrical wall which defines a passage between the ends of said cylindrical lift member, the axial length of said lift member being approximately equal to its diameter, said rod extending diametrally through said cylindrical lift member half way between the ends of such cylindrical lift member, said lift members being fixed relative to each other with their cylinder axes parallel, the cylindrical lift members having their one open ends coplanar with each other and their other open ends coplanar with each other.

20. The device of claim 19 in which said rotor further includes a circular stabilizing disk located between and fixed with respect to said cylindrical lift members to rotate therewith, the plane of the stabilizing disk being perpendicular to said rod, the diameter of said stabilizing disk slightly exceeding the diameter of said cylindrical lift members.

21. The device of claim 17 in which said rotor is formed by a single lift member formed from a flexible material defining a closed curve and forming a cylinder of noncircular cross section, the axis of said cylinder perpendiuclarly bisecting said axis of rotation, said lift member having four lobes, said lobes including two identical large lobes which extend outwardly in opposite directions generally parallel to the axis of rotation of the lift member, and two smaller lobes which are identical with one another and which extend outwardly in opposite directions rotation of the lift member, the lift surfaces being spaced from said axis of rotation between those positions.

22. The device of claim 17 in which the rotor comprises two identical lift members each firmly secured to a rod which passes from one end of the rotor to the other, each lift member comprising two identical circularly cylindrical tubes whose axes are perpendicular to the rod, the two cylindrical tubes of each lift member having a flat planar portion extending between them, along which flat planar portion the rod passes, each tube being open at opposed ends thereof and having a continuous thin cylindrical wall which defines a passage between said ends, the axial length of said tubes being approximately equal to their diameter and to the width of said flat planar portion between the tubes of each lift member, said retaining means being connected to said rod.

23. The device of claim 17 in which said rotor has two lift members and a rod supporting said lift members, each lift member having a generally S-shaped cross section, said rod passing lengthwise and centrally through each lift member and being secured to said lift member so that the rod and two lift members rotate together, each lift member having two side-by-side lift surfaces of opposite orientation, each of which lift surfaces extends between two positions coincident with the axis of rotation of the lift member, the lift surfaces being spaced from said axis of rotation between those positions.

24. The device of claim 17 in which the rotor comprises two lift members and a rod on which said lift members are fixed, each of said lift members being shaped as a letter "N" in cross section, each lift member thereby having end walls each perpendicular to the rod and a long diagonal wall interconnecting the end walls.

* * * * *

UNITED STATES PATENT AND TRADEMARK OFFICE

CERTIFICATE OF CORRECTION

PATENT NO. : 4 848 704

DATED : July 18, 1989

INVENTOR(S) : Kenneth Sams

It is certified that error appears in the above-identified patent and that said Letters Patent is hereby corrected as shown below:

Col. 10, lines 31-33; replace "rotation of the lift member, the lift surfaces being spaced from said axis of rotation between those positions." with ---generally perpendicular to the axis of rotation, the ends of the smaller lobes being spaced apart by a distance which slightly exceeds the length of the passage through the lift member, said rotor further including an elasticized line which connects the outer ends of the smaller lobes and extends diametrally therebetween, said retaining means being connected symmetrically to the ends of the larger lobes for rotation of said lift member with respect to said retaining means, said rotor being responsive to increasing wind strength by acting against said elasticized line in order to expand the distance between the ends of said smaller lobes.--.

Col. 9, line 35; change "retaining means" to ---a retaining means---.

Col. 9, line 62; change "of rotation such" to ---of rotation, such---.

Signed and Sealed this

Nineteenth Day of June, 1990

*Attest:*

HARRY F. MANBECK, JR.

*Attesting Officer*

*Commissioner of Patents and Trademarks*